US009617965B2

(12) United States Patent
Sanders et al.

(10) Patent No.: US 9,617,965 B2
(45) Date of Patent: Apr. 11, 2017

(54) REPETITIVE IGNITION SYSTEM FOR ENHANCED COMBUSTION

(71) Applicant: Transient Plasma Systems, Inc., El Segundo, CA (US)

(72) Inventors: Jason M. Sanders, Los Angeles, CA (US); Daniel Singleton, El Segundo, CA (US); Andras Kuthi, Thousand Oaks, CA (US); Martin A. Gundersen, San Gabriel, CA (US)

(73) Assignee: Transient Plasma Systems, Inc., El Segundo, CA (US)

( * ) Notice: Subject to any disclaimer, the term of this patent is extended or adjusted under 35 U.S.C. 154(b) by 252 days.

(21) Appl. No.: 14/571,128

(22) Filed: Dec. 15, 2014

(65) Prior Publication Data

US 2015/0167623 A1 Jun. 18, 2015

Related U.S. Application Data

(60) Provisional application No. 61/916,693, filed on Dec. 16, 2013.

(51) Int. Cl.

| | |
|---|---|
| ***F02P 3/08*** | (2006.01) |
| ***F02P 3/01*** | (2006.01) |
| ***F02P 23/04*** | (2006.01) |
| *F02P 7/04* | (2006.01) |
| *F02P 9/00* | (2006.01) |
| *F02P 15/10* | (2006.01) |
| *H01T 13/50* | (2006.01) |

(52) U.S. Cl.

CPC ..... *F02P 3/0838* (2013.01); *F02P 3/01* (2013.01); *F02P 23/04* (2013.01); *F02P 7/04* (2013.01); *F02P 9/007* (2013.01); *F02P 15/10* (2013.01); *H01T 13/50* (2013.01)

(58) Field of Classification Search

CPC .... F02P 3/08; F02P 3/02; F02P 3/0838; F02P 3/01; F02P 23/04; F02P 7/04; F02P 9/007; F02P 15/10; H01T 13/50

See application file for complete search history.

(56) References Cited

U.S. PATENT DOCUMENTS 4,433,669 A 2/1984 Ishikawa et al.
4,677,960 A 7/1987 Ward
(Continued)

FOREIGN PATENT DOCUMENTS

JP 2012-184718 9/2012

OTHER PUBLICATIONS

PCT Search Report and Written Opinion from PCT Application No. PCT/US2013/064955 issued from The Korean Intellectual Property Office dated Jan. 21, 2014.

(Continued)

*Primary Examiner* — Hieu T Vo

(74) *Attorney, Agent, or Firm* — Seed IP Law Group LLP

(57) ABSTRACT

A system and method for providing multiple fast rising pulses to improve performance efficiency. In one approach, multiple fast rising pulse power is employed to improve fuel efficiency and power of an engine. The system and method can involve a transient plasma plug assembly intended to replace a traditional spark plug. Alternatively, an approach involving a pulse generator and a high voltage pulse carrying ignition cable is contemplated.

11 Claims, 15 Drawing Sheets

(56) References Cited

U.S. PATENT DOCUMENTS

| | | | | |
|---|---|---|---|---|
| 5,157,267 | A | 10/1992 | Shirata et al. | |
| 6,633,017 | B1 | 10/2003 | Drummond et al. | |
| 6,831,377 | B2 | 12/2004 | Yampolsky et al. | |
| 6,906,280 | B2 * | 6/2005 | Rosocha | H05H 1/24 204/164 |
| 7,767,433 | B2 | 8/2010 | Kuthi et al. | |
| 7,901,929 | B2 | 3/2011 | Kuthi et al. | |
| 7,901,930 | B2 | 3/2011 | Kuthi et al. | |
| 8,115,343 | B2 | 2/2012 | Sanders et al. | |
| 8,120,207 | B2 | 2/2012 | Sanders et al. | |
| 8,226,901 | B2 * | 7/2012 | Makita | F02P 3/01 123/143 B |
| 8,418,668 | B2 | 4/2013 | Shimizu | |
| 9,080,547 | B2 * | 7/2015 | Shiraishi | F02D 41/3041 |
| 2003/0116148 | A1 | 6/2003 | Sakakura | |
| 2004/0182832 | A1 | 9/2004 | Rosocha | |
| 2005/0279337 | A1 | 12/2005 | Biljenga | |
| 2008/0274632 | A1 | 11/2008 | Lenfert et al. | |
| 2009/0126668 | A1 | 5/2009 | Shiraishi et al. | |
| 2009/0126684 | A1 | 5/2009 | Shiraishi et al. | |
| 2014/0109886 | A1 * | 4/2014 | Singleton | F02P 3/02 123/594 |
| 2014/0230770 | A1 | 8/2014 | Kuthi et al. | |

OTHER PUBLICATIONS

Kuthi, Andras, U.S. Appl. No. 61/767,044, filed Feb. 20, 2013, "Transient Plasma Electrode for Radical Generation." 7 pages.

* cited by examiner

REPETITIVE IGNITION SYSTEM FOR ENHANCED COMBUSTION

CROSS-REFERENCE TO RELATED APPLICATIONS

This application claims the benefit of U.S. Provisional Patent Application No. 61/916,693, filed Dec. 16, 2013, which is hereby incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This description relates to ignition systems, and, more particularly, to systems and methods that produce transient plasma streamers for improving efficiency of performance of combustion engines.

BACKGROUND

Nonequilibrated transient plasmas containing high energy electrons can be used in place of a thermally equilibrated electrical arc to ignite fuel-air mixtures. Depending on operating conditions, the combustion process may be enhanced when the fuel-air mixture is ignited by a non-equilibrated transient plasma compared to when the mixture is ignited by a thermally equilibrated arc or spark. Experiments in a variety of engines have shown that these improvements in the combustion process include higher peak cylinder pressure, increased indicated mean effective pressure, reduced ignition delay, and the ability to reliably ignite leaner mixtures. Recent work has shown that these performance improvements may be enhanced in some operating conditions by applying more than one transient plasma discharge event before and/or during a single combustion event. To accomplish this, a power source is required to produce one or more transient plasma discharge(s) at a given rate. This disclosure describes electrical circuitry designed to produce one or more electrical pulses, each pulse generally having a duration between 1 nanosecond and 1 microsecond, as well as methods for integrating this circuitry with an engine.

SUMMARY

Briefly and in general terms, the present disclosure is directed to systems and methods for producing multiple fast rate electrical pulses for the purpose of producing nonequilibrated transient plasma discharges. The duration of each electrical pulse may vary, and in certain embodiments, the duration of the electrical pulses is less than 1 microsecond. In the embodiments disclosed, these systems and methods are employed to ignite air-fuel mixtures in an engine.

In some embodiments, disclosed circuitry is directly powered by an available DC power source, typically a 12 VDC or 24 VDC battery found in an airplane or ground based vehicle. These circuits make use of a DC-DC power converter to increase the available DC voltage to a higher DC voltage. Energy is stored at a higher voltage in a capacitor or capacitors that supply power to a circuit designed to switch this stored energy into circuitry that compresses the energy in time to produce one or more high voltage pulses with an amplitude(s) between 1 kV and 100 kV and a duration(s) between 1 ns and 1 μs. The energy stored by the capacitor or capacitors at the output of the DC-DC power converter exceeds the energy of a single pulse produced by the compression circuitry by a factor determined by the total number of pulses produced per combustion event. This factor is between 1 and 50.

In other embodiments, disclosed circuitry is powered by a signal generating source (e.g. an ignition coil), which outputs electrical energy that powers circuitry designed to store this energy and subsequently compress it into one or more electrical pulses with an amplitude(s) between 1 kV and 100 kV and a duration(s) between 1 ns and 1 μs.

In yet other embodiments, disclosed circuitry produces one or more electrical pulses with an amplitude(s) between 1 kV and 100 kV and a duration(s) between 1 ns and 1 μs, and these pulse(s) are superimposed on a slower pulse, featuring a duration between 1 μs and 100 ms. The slow pulse may be generated by a conventional spark source, such as an ignition coil. The faster pulses may be generated by circuitry similar to the circuitry described above.

As disclosed herein, the transient plasma circuit or pulse generator enables an engine to ignite an air-fuel mixture more efficiently (e.g., burn fuel more completely). This is accomplished by minimizing or avoiding the transition from plasma to spark break down. Less fuel is consequently required to achieve the same or greater power output. In this regard, the air-fuel mixture may be adjusted accordingly (e.g., decrease the amount of fuel). Even without adjusting the air-fuel mixture, the more efficient combustion that results from the high-voltage pulses yields better gas mileage (i.e., more power is output by the engine without adjusting the air-fuel mixture). Fast rise, ultra-short, high voltage electrical pulses are generated within a nanosecond time frame such that energy is utilized in a more efficient process to create energetic electrons (e.g., plasma, or more specifically, plasma streamers). Such energetic electrons collide with the air-fuel mixture in a volume (e.g., a piston chamber), thereby breaking down the mixture and making it easier to burn.

In addition, methods for enhancing the ignition of air-fuel mixtures are disclosed herein. The method includes generating a fast rising voltage pulse, creating a transient plasma, and introducing the transient plasma with an air-fuel mixture to create reactive species thereby enhancing efficiency of combination chemistry.

The ability for transient plasma to enhance the ignition and/or combustion process is due in part to the generation of reactive species, such as atomic oxygen, that are contained in the transient plasma. A method for increasing the density of these reactive species is disclosed herein, wherein a plurality of transient plasma events are produced in short succession so that the density of these radicals grows over time.

The disclosed methods for enhancing ignition and combustion are intended to benefit any type of fuel burning engine, regardless of the fuel and regardless of the engine type (internal combustion, diesel, etc.). The implementation varies depending on engine type, with typical implementations for internal combustion engines featuring igniters that thread into the engine head through the spark plug hole, and typical implementations for diesel engines featuring igniters that thread into the engine head through the glow plug hole.

The foregoing summary does not encompass the claimed subject matter in its entirety, nor are the embodiments intended to be limiting. Rather, the embodiments are provided as mere examples.

Other features of the disclosed embodiments will become apparent from the following detailed description, taken in conjunction with the accompanying drawings, which illustrate, by way of example, the principles of the disclosed embodiments.

DETAILED DESCRIPTION OF THE PREFERRED EMBODIMENTS

The present disclosure relates to igniting air-fuel mixtures, including but not limited to igniting air-fuel mixtures in internal combustion engines. In combustion engines, air-fuel mixtures are typically ignited by an electrical pulse with a duration of many microseconds, which initiates an electrical breakdown. For pulses with durations of approximately one microsecond and longer, this discharge ultimately becomes an arc, and the heat generated by the arc raises the temperature of the air-fuel mixture to its ignition temperature. Shorter, nanosecond duration pulses with sufficiently high-peak power can enhance the combustion process by applying electrical energy more directly to the air-fuel mixture by virtue of high-energy electrons. These high energy electrons, which are not found in discharges created by traditional ignition systems that produce longer pulses, collide with molecules in the air-fuel mixture and create reactive species that enhance combustion chemistry. This results from minimizing or avoiding the transition from plasma to spark break down. As disclosed herein, this can result in improved fuel efficiency and performance. To realize these benefits, it is necessary for the rate of rise of the voltage pulse that creates the discharge to be sufficiently fast. This fast rising pulse enables a formative phase of plasma, which may consist of plasma streamers. These streamers contain the high energy electrons which play a major role in realizing the benefits described herein.

Accordingly, disclosed herein is a system and method incorporating fast rise, ultra-short, high energy pulses that (1) ignite fuel more quickly, (2) more readily, (3) ignites complex fuels, (4) ignites leaner mixtures, ignites faster moving mixtures, and (5) that produces more power from the fuel. This approach, thus, produces (1) an increase in engine efficiency, (2) a reduction in emission and ignition delay and (3) a leaner burn compatibility. An increase of 20% efficiency or more can result, along with as much an increase of 30% increase in pressure while using less energy. This increased power is achieved even when the air-fuel mixture remains constant. Thus, there is an increase in fuel efficiency as the air-fuel mixtures are burned.

Figure 1:
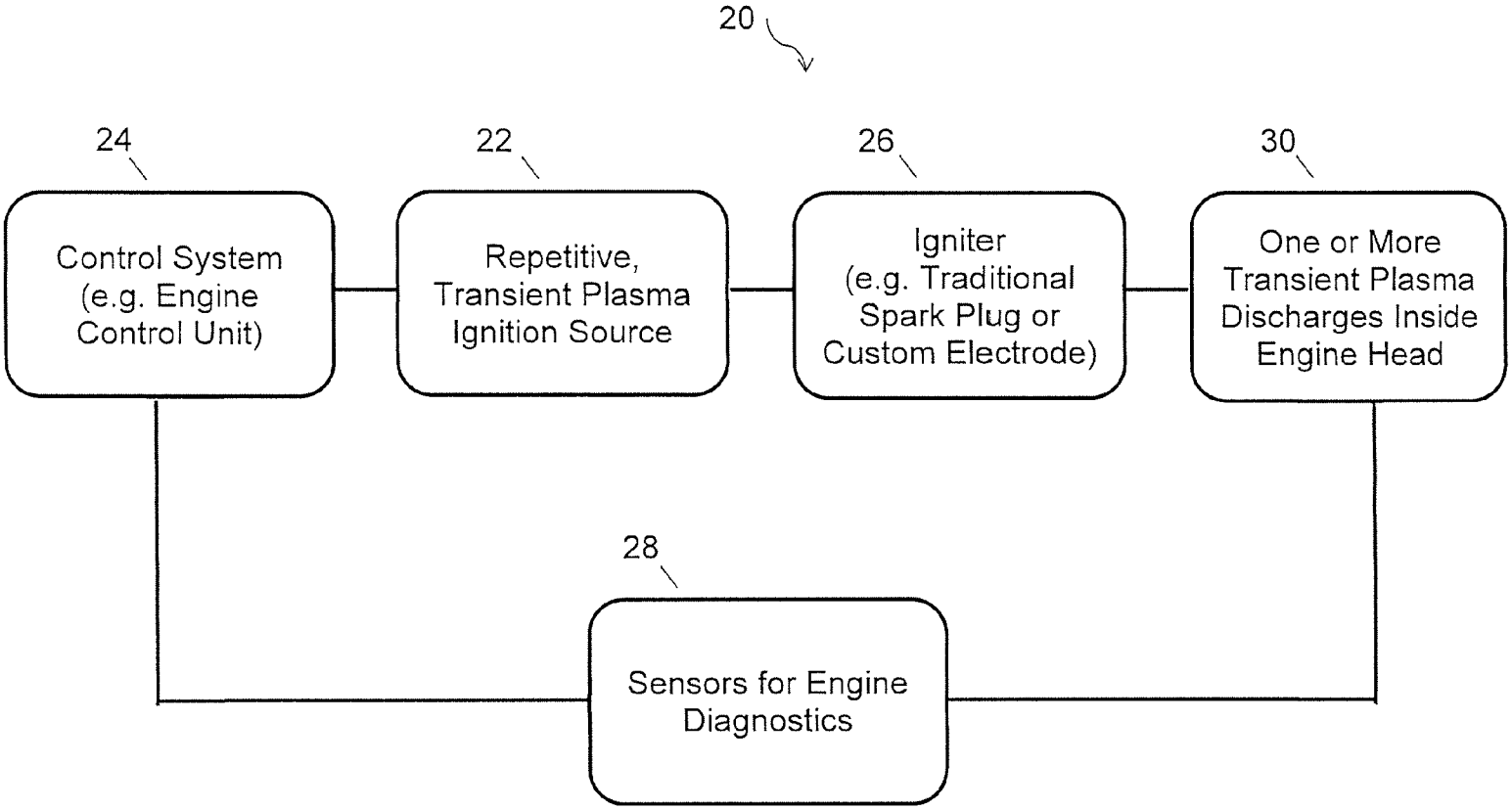
FIG. 1 is a block diagram, depicting one configuration in which a repetitive transient plasma ignition source is used in place of a traditional ignition system. A control system is used to control timing and the number of pulses applied to the igniter.
Figure 2A:
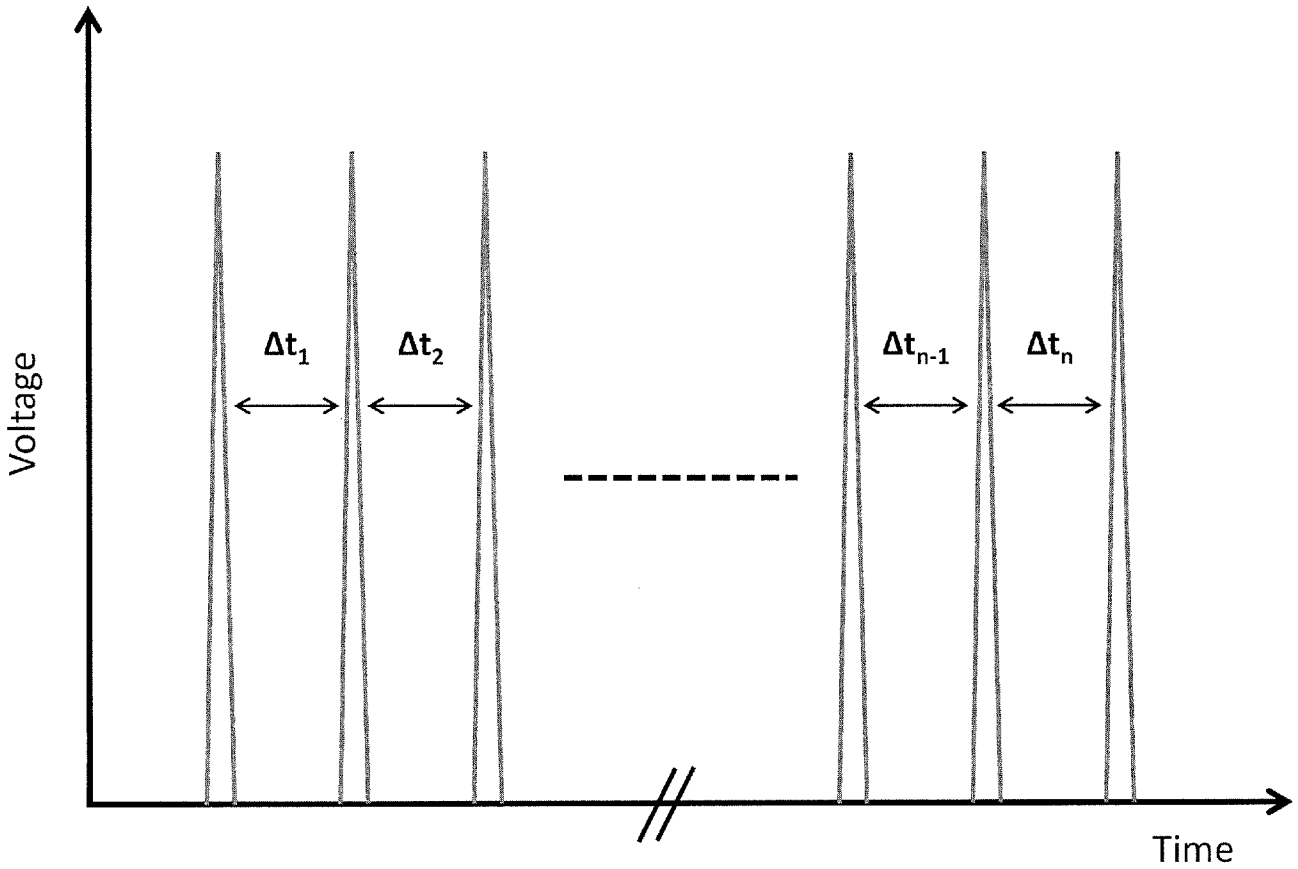
FIG. 2A is graphical representation, depicting a train of pulses of nanosecond duration produced by the transient plasma ignition source, which is capable of producing one or more of these pulses. Each individual pulse has a duration that may be between 1 nanosecond and 100 nanoseconds, and an amplitude that is sufficiently high to produce transient plasma. The required amplitude to produce a transient plasma is a function of the igniter design as well as the temperature and pressure of the engine; typical igniter designs require an amplitude between 10 kilovolts and 50 kilovolts. The number of pulses and the spacing between each pulse may be adjusted dynamically by the engine control system. The maximum spacing between neighboring pulses is 1 millisecond.
Figure 2B:
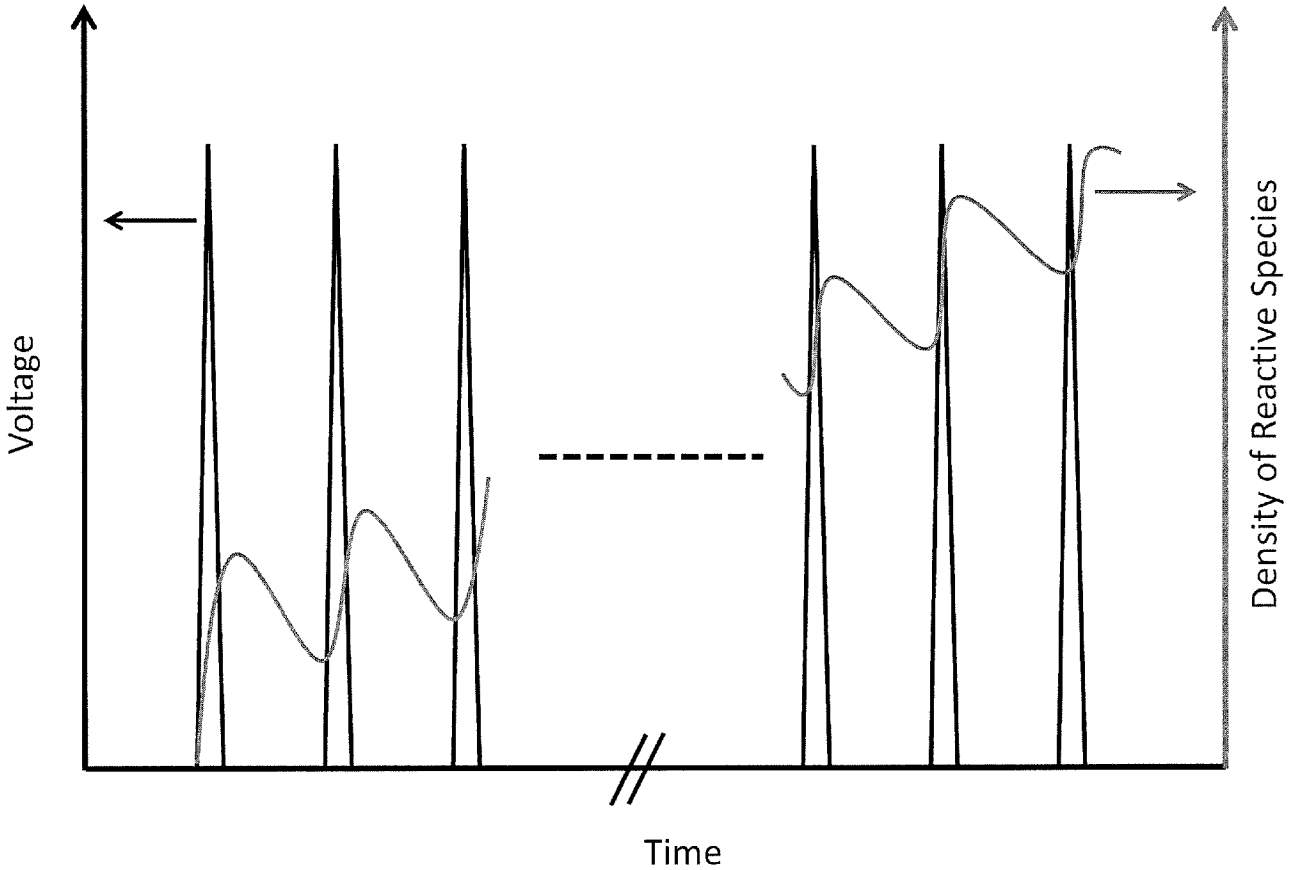
FIG. 2B is a graphical representation, depicting the concept of building the density of reactive species in the transient plasma by means of applying multiple pulses of nanosecond duration, which produce multiple transient plasma discharges. After each discharge, the density of these species grows rapidly and then begins to decay. By applying the pulses with a spacing that is shorter than this decay time, the density can reach levels higher than the density achievable by a single pulse.

Referring now to the Figures, wherein like numerals denote like or similar structures, and, more particularly to FIG. 1, one embodiment of a system 20 includes a repetitive transient plasma ignition source 22 for producing transient plasma, referred to hereafter as the transient plasma ignition source. The circuitry will be configured such that it is capable of switching the full energy contained in the nanosecond pulse such that the spacing between the nanosecond pulses is less than or equal to 1 millisecond. A control system 24 that controls timing, typically referred to as an Engine Control Unit (ECU) for automobiles, will be reconfigured as needed to advance or retard the timing of when the transient plasma source is triggered relative to the position of the piston. This system may also adjust pulse parameters, such as pulse amplitude, number of pulses per burst, and pulse spacing, and these adjustments may be made in real time in response to diagnostics fed back to this system; these diagnostics may include but are not limited to the engine's rotations per minute (RPM), temperature measurements, and pressure measurements. The system 20 may include an igniter 26, such as a traditional spark plug or any type of custom electrode. Also, the system 20 may include sensors 28 for engine diagnostics. One or more transient plasma discharges 30 will occur inside the engine head.

In another configuration, the transient plasma ignition source 22 is sufficiently miniaturized that there is one of these sources for each engine cylinder, thus eliminating the need for cabling to transmit the nanosecond pulse.

Figure 3:
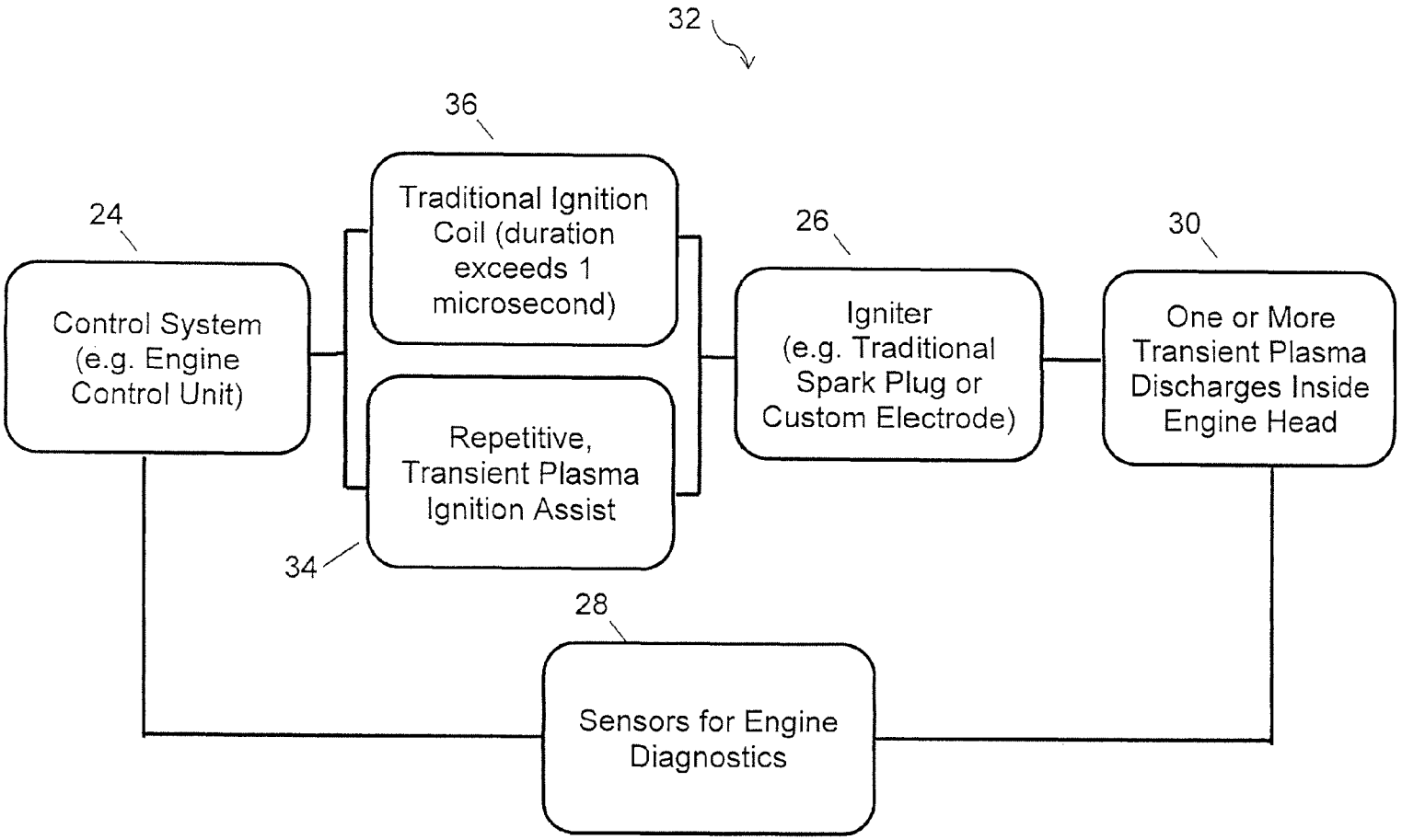
FIG. 3 is a block diagram, depicting a second configuration in which a repetitive transient plasma source is used in parallel with an existing ignition system that produces a slower pulse, which is longer than 1 microsecond. In this configuration, pulses of nanosecond duration are generated by a transient plasma source, and these pulses are coupled, either magnetically or capacitively, to the igniter. In this way, the pulses of nanosecond duration are superimposed on top of the slow ignition pulse. The intention of producing multiple pulses of nanosecond duration is the same as described above with reference to FIGS. 2A and 2B. In one embodiment, a control system is used to control both the slow ignition source and the transient plasma source, adjusting the timing and the number of nanosecond pulses generated by the transient plasma source as well as the timing of the slow ignition pulse.
Figure 4:
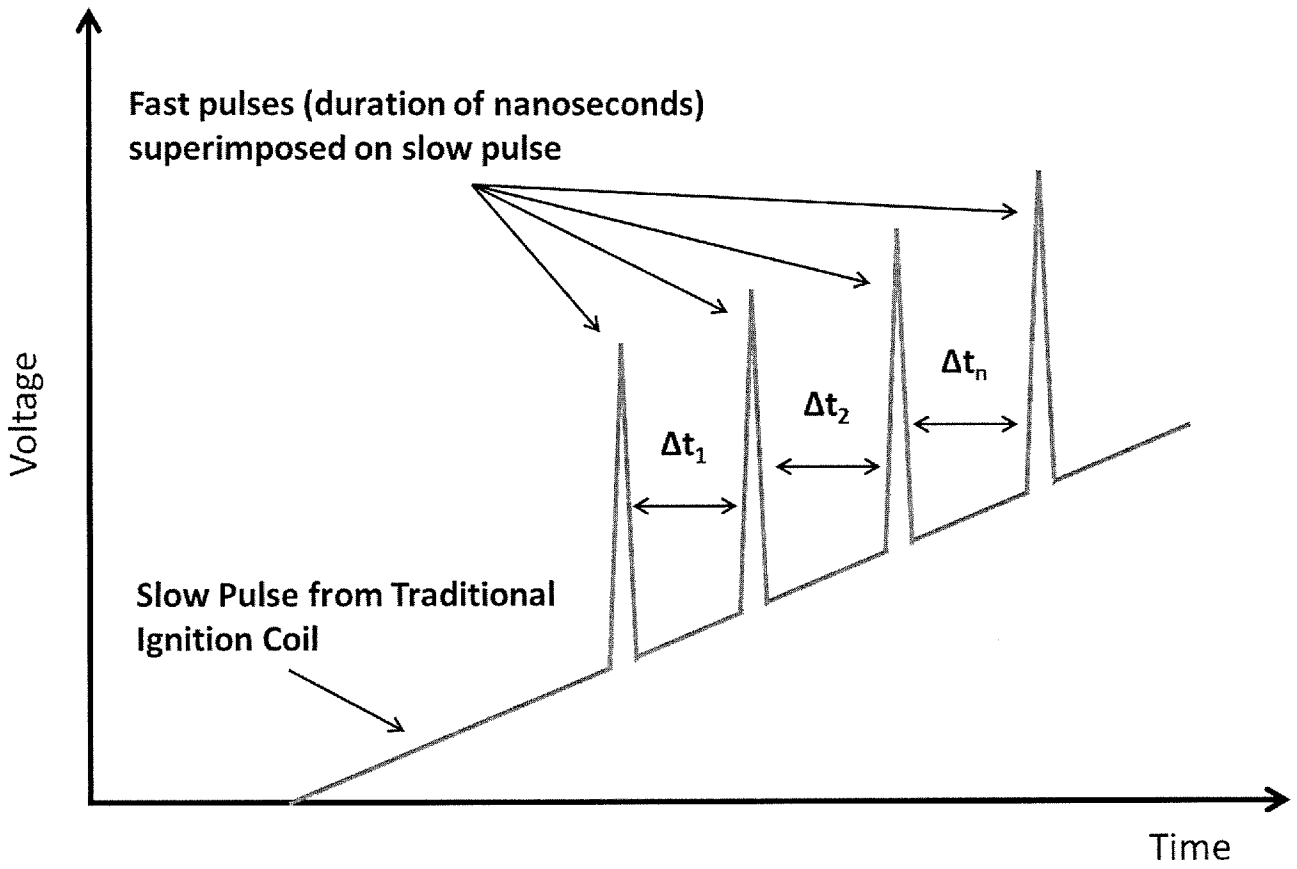
FIG. 4 is a graphical representation, depicting one possibility of how the pulse generated by the second configuration shown in FIG. 3 looks. One or more pulses of approximately a nanosecond duration are superimposed on top of the slow pulse created by a more traditional ignition system that produces pulses with duration longer than 1 microsecond. In this graphical representation the slow pulse produced by the traditional ignition source is depicted as a ramp, but other pulse shapes are possible, such as a square, a triangle, or a more general shape that may be oscillating or non-monotonic.

As depicted in FIG. 3, a system 32 includes a transient plasma ignition assist 34 that is designed to produce one or more fast rate pulses that work together with a traditional, slow pulse ignition source 36 to produce a transient plasma assist, whereby fast pulses that create transient plasma are superimposed on top of the slower traditional ignition pulse. For this configuration, the fast pulses are either capacitively or magnetically coupled to the igniter. In one embodiment, there is a series capacitor between the output of the transient plasma ignition assist 34 and the input of the igniter 26; there is also a shunt resistor from the output of the nanosecond pulse generating circuitry and ground. The traditional, slow pulse ignition system 36 is directly connected to the input of the igniter 26. The value of the resistor and capacitor are chosen such that the RC time constant is short compared to the rise time of the traditional, slow ignition pulse and long compared to the nanosecond pulse. In this embodiment, the RC time constant is chosen to be the geometric mean of the rise time of the slow pulse rise time and the nanosecond pulse rise time, $\tau=\sqrt{t_{ns}\times t_{slow}}$.

Figure 5:
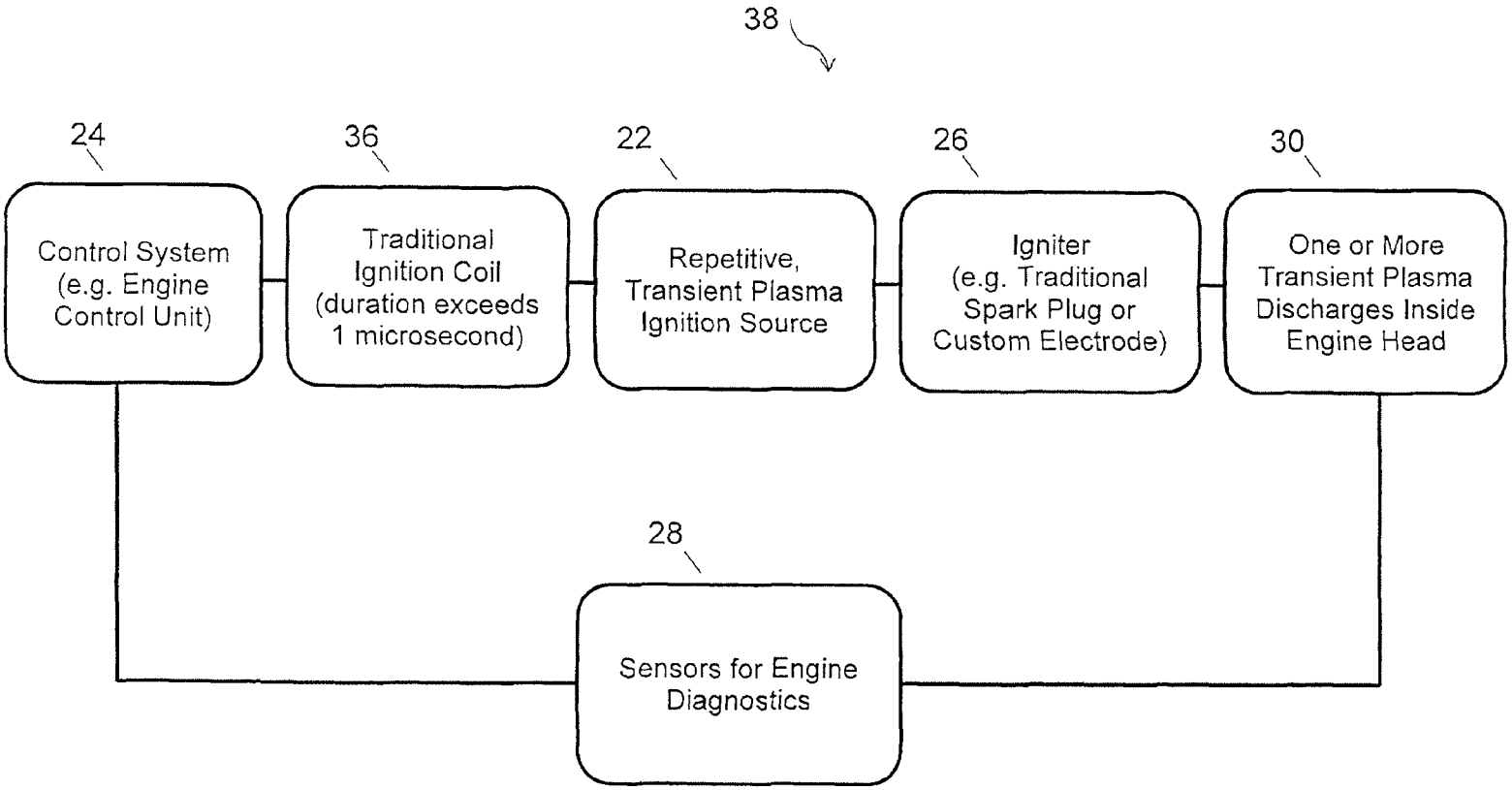
FIG. 5 is a block diagram, depicting a third configuration in which a repetitive transient plasma source is used in series with an existing ignition system that produces a slower pulse, which is longer than 1 microsecond. In this configuration, pulses of approximately a nanosecond duration are generated by circuitry that is charged by the slow ignition pulse. Once the circuitry is charged to a sufficient energy level, one or more pulses of nanosecond duration are produced. The intention of producing a train of these pulses is the same as described above with reference to FIGS. 2A and 2B. In one embodiment, a control system is used to control both the slow ignition source and the transient plasma source, adjusting the timing and the number of nanosecond pulses generated by the transient plasma source as well as the timing of the slow ignition pulse. In this graphical representation, the slow pulse produced by the traditional ignition source is depicted as a ramp, but other pulse shapes are possible, such as a square, a triangle, or a more general shape that may be oscillating or non-monotonic.
Figure 6:
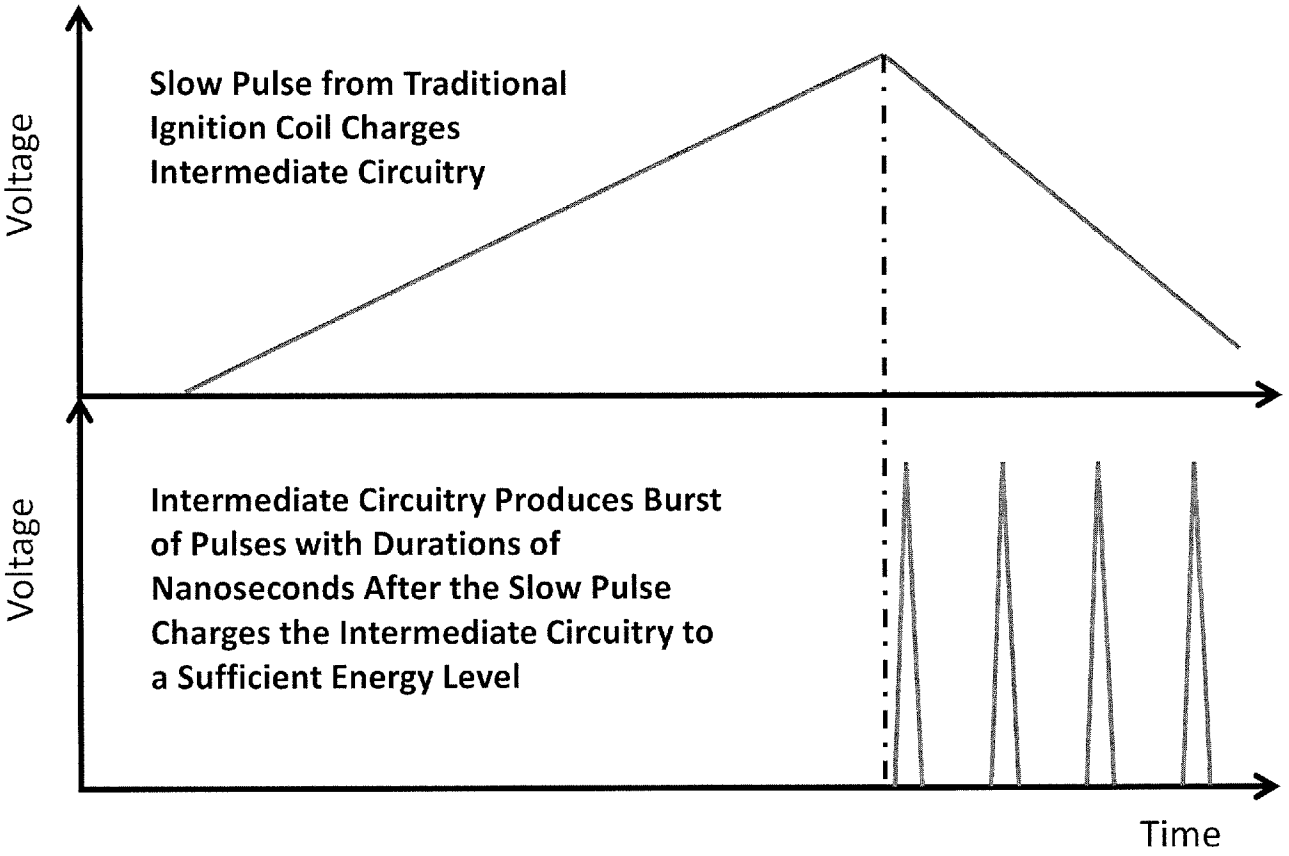
FIG. 6 is a graphical representation, depicting one possibility of how the pulses generated by the system represented by the block diagram of FIG. 5 would look. The energy contained in the slow rising pulse (top) is stored in an intermediate stage. Once this energy reaches a predetermined level, circuitry designed to produce nanosecond discharges is activated. The circuitry that produces the nanosecond pulses is powered by the energy stored in the intermediate stage. As one or more nanosecond pulses are produced, the energy stored in the intermediate stage decays.

As depicted in FIG. 5, a system 38 includes a traditional ignition source 36 that produces a slow pulse that charges circuitry, and subsequently produces multiple fast rate pulses once charged to a sufficient energy level. In this and other embodiments, the duration of each fast rate pulse may vary. In one embodiment, the duration of each fast rate pulse is less than 1 microsecond. In one embodiment, the source may be comprised of a high energy ignition source capable of producing output energy greater than 100 mJ. The term "ignition source" is used to refer to the circuitry traditionally used to create a spark across a spark plug for igniting fuel-air mixtures. Traditionally, this circuitry consists of an auto-transformer with a large voltage step-up ratio that is powered by current stored in the primary winding of the auto-transformer, which is supplied by a 12 VDC source. An ignition control module, traditionally comprised of an insulated gate bipolar transistor and control circuitry, interrupts the current flowing through the primary, resulting in a high voltage transient across the secondary winding, which causes an electrical arc to form across the spark plug. Modern, high energy ignition sources also introduce an intermediate stage between the 12 VDC power source and the auto-transformer, which typically steps-up the 12 VDC to a higher voltage and includes capacitive energy storage. Any of these circuits apply herein when referring to "ignition source", provided they supply an output pulse with an energy of at least 10 mJ. The output of the ignition source is connected to an intermediate energy storage stage, which is a capacitor in this embodiment. After the capacitor is fully charged, the transient plasma ignition source 22 begins producing one or more pulses once it is triggered by the engine control unit 24. The energy of each of the nanosecond pulses is supplied by the energy previously supplied to the capacitor by the ignition source. In between bursts of pulses, the traditional ignition coil is activated, and its output energy is transferred to the input capacitance.

Figure 7:
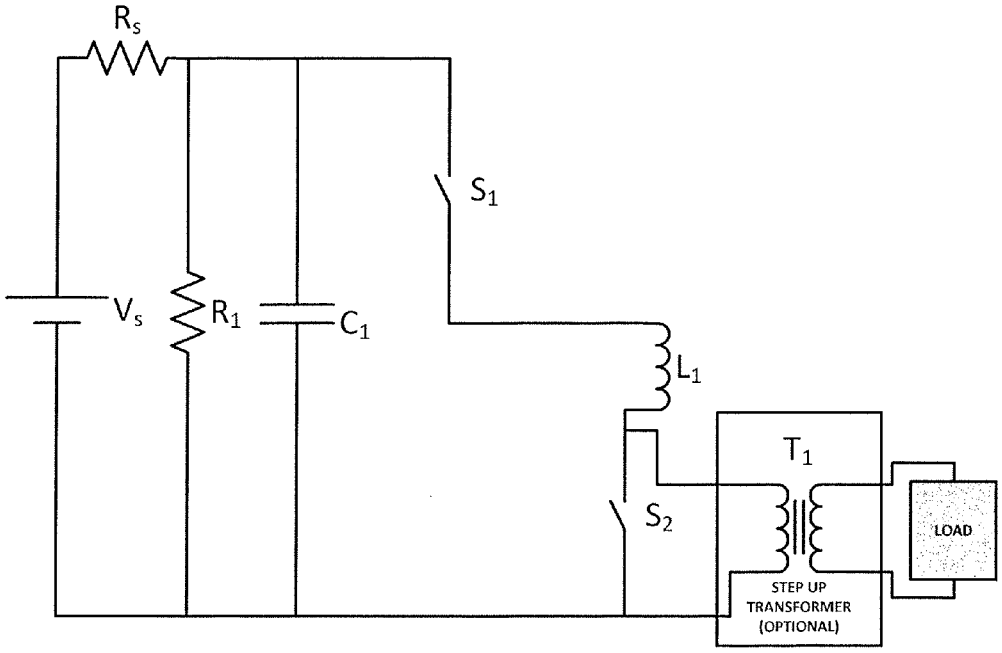
FIG. 7 is a graphical representation, depicting a simplified schematic intended to illustrate the conceptual operation of circuitry designed to create one or more nanosecond pulses. The capacitor $C_1$ is charged by an energy source, represented by $V_s$ and $R_s$. Switch $S_2$ is initially closed and switch $S_1$ is initially open. When triggered, switch $S_1$ closes, allowing current to flow through both $L_1$ and $S_2$. As current flows, energy is stored in $L_1$ in the form of a magnetic field. When the energy in $L_1$ reaches a sufficient value (between 5 mJ and 5 J), switch $S_2$ opens rapidly, interrupting the current through $L_1$, which creates a voltage pulse. A step-up transformer may be connected between the circuit's output and the load.

FIG. 7 depicts a simplified schematic intended to conceptually explain the operation of one embodiment of the transient plasma ignition source. The energy source represented by $V_s$ and Thévenin resistance $R_s$ charges the input capacitor, $C_1$ to the source voltage, $V_s$. During this charging period, switch $S_1$ is open, ensuring energy flows only into $C_1$, and not into any of the downstream circuit components. When a trigger signal from either a distributor, an engine control unit (ECU), or any other system that controls ignition timing, switch $S_1$ closes for a period of time, allowing current to flow from $C_1$ into inductor $L_1$ and switch $S_2$, which is closed when switch $S_1$ closes. The current flows for a predetermined period of time, building up energy stored in the magnetic field of the inductor, at which point switch $S_2$ opens, preventing the current from continuing to flow through switch $S_2$. The switching time from closed to open for switch $S_2$ is less than 500 ns. When this happens, the current that was flowing through switch $S_2$ flows instead through the load, creating a voltage pulse across the load. The amplitude and duration of the pulse is determined by the switching time of $S_2$, the value of inductor $L_1$, the source voltage $V_s$, and the load impedance, represented in FIG. 7 as "LOAD".

Figure 8:
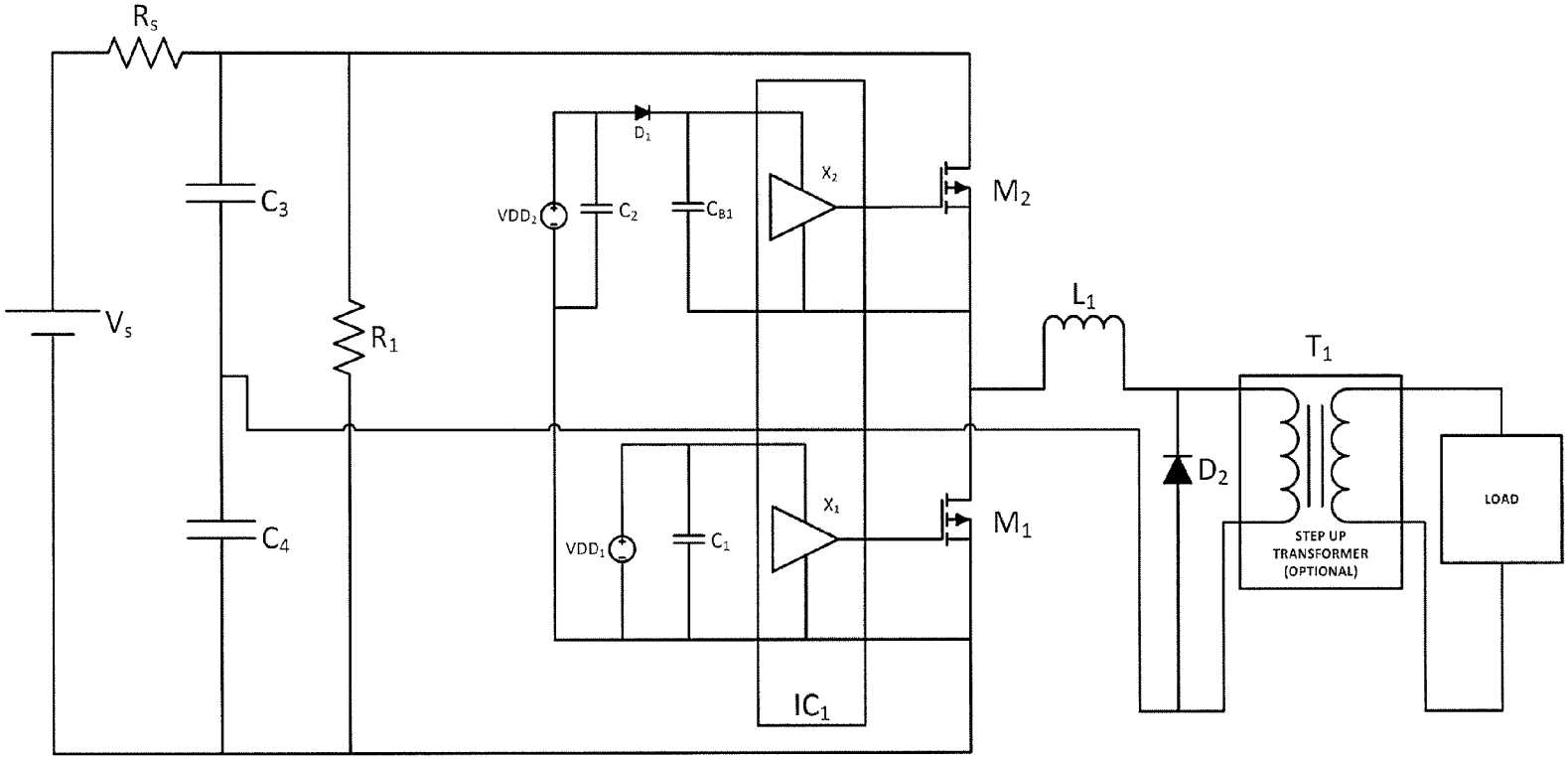
FIG. 8 is a graphical representation, depicting a circuit that is a practical implementation of the conceptual schematic shown in FIG. 7. The opening switch, $S_2$, from FIG. 7 has been replaced by a diode that operates as an opening switch. The half-bridge configuration is switched in such a way that the diode is pulsed with a current in the forward biased direction for a period of time. Following this forward biased current pulse, a reverse biased current pulse is applied. This current flows through the diode until it becomes reverse biased, at which point the diode rapidly stops conducting and a voltage pulse is created across the load. An optional step-up transformer may be connected between the output of the circuit and the load.

FIG. 8 depicts a simplified, practical circuit that is capable of operating in a way very similar to the conceptual circuit. The closing switch $S_1$ from FIG. 7 is realized by semiconductor switches $M_1$ and $M_2$; the opening switch $S_2$ from FIG. 7 has been realized by a diode switch, $D_2$. The diode switch takes advantage of the diode's reverse recovery time, i.e. the time it takes for the diode to become reverse biased after current begins flowing in the reverse direction. For this switching mechanism to work properly, the diode must be pulsed with a forward biased current for a period between 50 ns and 10 μs. At the end of the forward biased current pulse, a reverse biased current pulse is applied. This reverse current flows, removing charge stored in the diode's junction from the forward biased pulse, for a period of time typically referred to the reverse recovery time. Once the stored charge has been removed, the diode becomes reverse biased, and its conductivity rapidly changes from a high state to a low state. For simplicity, the diode, $D_2$ is shown as a single diode, but in practice it may be an array composed of multiple series and/or parallel diodes. $M_1$ and $M_2$ are controllable switches arranged in a half bridge configuration. They are shown as MOSFETs in FIG. 8, but they may be a number of other types of voltage/current controlled devices, including but not limited to, insulated gate bipolar transistors (IGBT), thyristor, silicon controlled rectifier (SCR), or bipolar junction transistors (BJT).

Figure 9:
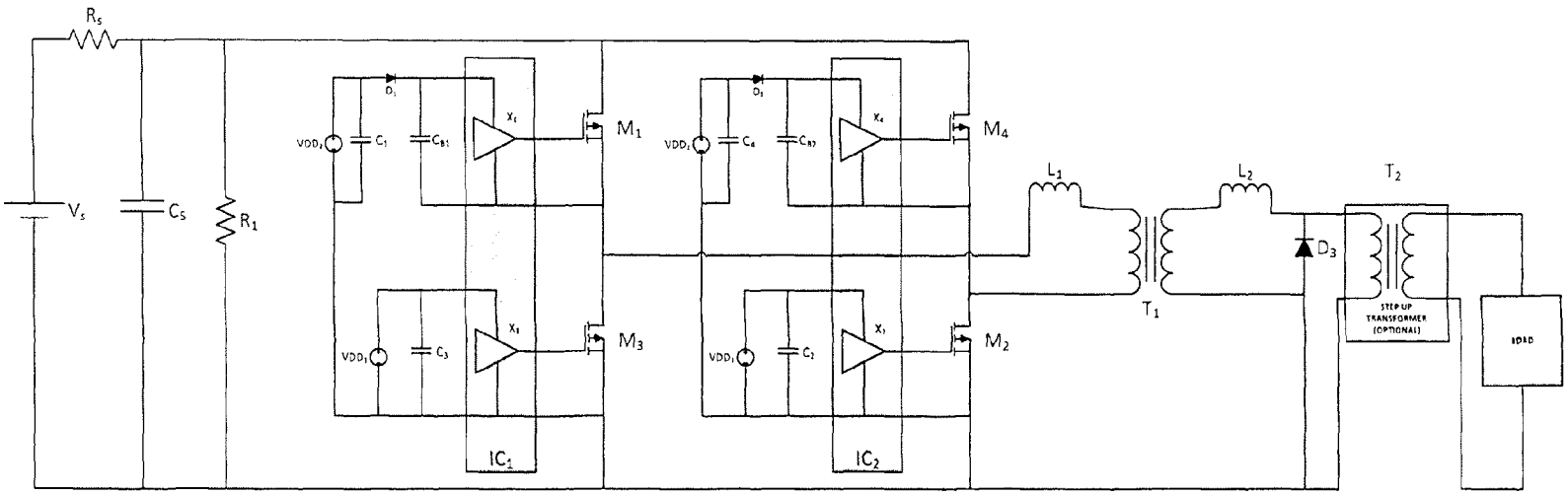
FIG. 9 is a graphical representation, depicting a circuit that is a practical implementation of the conceptual schematic shown in FIG. 7. Like the circuit shown in the FIG. 7, this circuit makes use of a diode as an opening switch, but in this circuit, the half bridge configuration has been replaced with a full bridge configuration. The advantage of a full bridge configuration is that the full source voltage, Vs, is switched across the diode and inductor; whereas, only a fraction of the source voltage is switched across the diode and inductor for the half-bridge. An isolating transformer, $T_1$, is used to ensure proper current flow between the switched voltage, which floats above $M_2$ and $M_3$, and the diode, $D_3$, and load, which are typically ground referenced. An optional step up transformer, $T_2$, may be connected between the output and the load.

FIG. 9 depicts a simplified circuit that operates similarly to the circuit shown in FIG. 8, except that the half bridge in FIG. 8 has been replaced by a full bridge. The advantage to this approach is that the full supply voltage, Vs, is switched across the inductor and diode; whereas, only a fraction of the supply voltage is switched across the inductor and the diode when a half bridge is used. Switching a larger voltage is advantageous because it enables more energy to be stored in the inductor per unit time. An isolating transformer, $T_1$, is used to ensure proper current flow between the switched voltage, which floats above $M_2$ and $M_3$, and the diode, $D_3$, and load, which are typically ground referenced. An optional step up transformer, $T_2$, may be connected between the output and the load. For simplicity the diode, $D_3$ is shown as a single diode, but in practice it may be an array composed of multiple series and/or parallel diodes. $M_1$ through $M_4$ are depicted as MOSFETs, but they may be a number of other types of voltage/current controlled devices, including but not limited to, insulated gate bipolar transistors (IGBT), thyristor, silicon controlled rectifier (SCR), or bipolar junction transistors (BJT).

The following equations describe how the diode switch of any of the disclosed embodiments works. $Q_r$ is the amount of charge that must be removed from the junction after it has been forward biased before the diode becomes reverse biased. The ratio $Q_r/Q_f$, where $Q_f$ is the charge stored in the junction after the diode has been pulsed with a forward biased current pulse, is always less than one and is referred to herein as y. Provided that the duration of the forward biased current pulse is short compared to the lifetime of the minority carriers of the diode, equation 2 is a reasonably good approximation for $Q_f$ provided the shape of the forward biased current pulse is approximately triangular. Equation 3 is easily derived using the constitutive equation for an inductor, where $V_p$ is the voltage applied across the inductor and diode during the forward biased current pulse (duration represented by $t_p$), and it is assumed that $V_p$ is nearly constant.

The inherent phase shift between voltage and current across and through an inductor described by its constitutive equation implies that for the forward biased current through the inductor to decrease, the voltage applied across the inductor and diode must change polarities from positive to negative. This is accomplished by the half-bridge switching configuration of $M_1$ and $M_2$ shown in FIG. 8, or the full-bridge configuration of $M_1$ through $M_4$ shown in FIG. 9. Consider the half-bridge of FIG. 8: for the first part of the forward biased pulse, $t_p$, $M_1$ is on and $M_2$ is off, and the voltage across $C_4$, $V_{C4}$, is applied with a positive polarity with respect to the diode's anode across the diode and inductor. The voltage across $C_4$ is also referred to herein as $V_p$. During this time period, the current through $D_2$ and $L_1$ rises linearly. After this first part $t_p$, $M_1$ turns off and $M_2$ turns on, and the voltage across $C_3$, $V_{c3}$, is applied with a negative polarity with respect to the diode's anode across the inductor and diode. The voltage across $C_3$ is also referred to herein as $V_n$. When $V_n$ is applied, the current through $D_2$ and $L_1$ decreases linearly, eventually crossing a zero point and going negative. Once the current crosses the zero point, $t_p$ ends and $t_n$ begins. During the $t_n$ interval, which is the reverse current period, the negative current grows linearly until the charge deposited in the diode's junction during the forward biased pulse is removed, at which point the diode becomes reverse biased and rapidly stops conducting current; the time interval $t_n$ ends at this point. Equation 4 describes the total amount of charge removed from the diode during $t_n$. Equating equations 1-4 yields equation 5; this is then simplified to equations 6 and 7. Equation 7 describes the relationship between the source voltage, $V_s$, which is given by $|V_p+V_n|$, and the diode pumping times, $t_p$ and $t_n$, that must be met in for the diode to switch properly.

$$Q_r = \gamma Q_f \quad 1)$$

$$Q_f = \frac{I_f t_f}{2} = I_f t_p \quad 2)$$

$$Q_f = \frac{V_p t_p^2}{L} \quad 3)$$

$$Q_r = \frac{V_n (t_n - t_p)^2}{2L} \quad 4)$$

$$\frac{V_n (t_n - t_p)^2}{2L} = \gamma \frac{V_p t_p^2}{L} \quad 5)$$

$$V_n (t_n - t_p)^2 = 2\gamma V_p t_p^2 \quad 6)$$

$$\frac{V_p}{V_n} = \frac{2\gamma t_p^2}{(t_n - t_p)^2} \quad 7)$$

Ignoring component losses, the energy of the pulse delivered to the load, which is a function of the voltage across $C_3$ ($V_n$) and pumping times, $t_p$ and $t_n$, is given by Equation 8. If the input voltage, $V_s$, which is given by $|V_p+V_n|$, were to change in value, Equation 8 indicates that the pulse energy can remain constant provided that the pumping times $t_n$ and $t_p$ are properly adjusted. This condition for constant pulse energy is given in Equation 9, which shows that the energy will remain constant provided that the magnetic flux applied to the inductor, $L_1$, remains constant.

$$E_p = \frac{L I_r^2}{2} = \frac{[V_n (t_n - t_p)]^2}{2L} \quad 8)$$

$$V_n (t_n - t_p) = \Phi_c \quad 9)$$

If the circuit that produces the train of pulses is powered by a source with finite energy, where the total energy contained in source is within two orders of magnitude of the sum of the energies of each pulse in the train, then the duration of timing intervals $t_p$ and $t_n$ can be adjusted to maintain constant magnetic flux to compensate for the reduction of $V_n$, which falls as energy is drawn from the source. This approach is practical up until the point the durations of $t_n$ and $t_p$ exceed reasonable durations for diode switch pumping, where a reasonable duration is 10 μs.

A practical implementation of this is realized by a microcontroller that is programmed with a lookup table that links the durations for $t_n$ and $t_p$ to the voltage of the energy source. The source's voltage will be fed into the microcontroller through a voltage attenuator, with a known attenuation factor, which scales the source's voltage to be within acceptable voltage limits for the microcontroller.

The energy source, represented by $V_s$ and $R_s$, may be realized in a number of different ways, depending on the specifications of the application. In one embodiment, the source may be comprised of a high energy ignition source capable of producing output energy greater than 100 mJ. The term "ignition source" is used to refer to the circuitry traditionally used to create a spark across a spark plug for igniting fuel-air mixtures. Traditionally, this circuitry consists of an auto-transformer with a large voltage step-up ratio that is powered by current stored in the primary winding of the auto-transformer, which is supplied by a 12 VDC source. An ignition control module, traditionally comprised of an insulated gate bipolar transistor and control circuitry, interrupts the current flowing through the primary, resulting in a high voltage transient across the secondary winding, which causes an electrical arc to form across the spark plug. Modern, high energy ignition source also introduce an intermediate stage between the 12 VDC power source and the auto-transformer, which typically steps-up the 12 VDC to a higher voltage and includes capacitive energy storage. Any of these circuits apply herein when referring to "ignition source", provided they supply an output pulse with an energy of at least 10 mJ. The output of the ignition source is connected to the input capacitance, either by a conducting wire, a high voltage diode, or a resistor. In between bursts of pulses, the ignition source is activated, and its output energy is transferred to the input capacitance.

In another embodiment a DC-DC power converter may be used to recharge the input capacitance in between bursts of pulses. The input of this converter is connected to the DC power source associated with the engine, typically 12-14 VDC for automotive engines. After a burst of output pulses is produced by the circuitry, the DC-DC power converter is activated, at which point a semiconductor switch is used to repetitively switch the engine's DC power source to chop it up into an alternating signal. The alternating signal is stepped up to charge the input capacitance to the desired operating voltage. In one embodiment, this DC-DC converter may be realized by utilizing a flyback converter topology, in which the engine's DC power source is repetitively switched across the primary of a step-up transformer. When the switch is closed, current flows through the primary, inducing energy storage in the transformer's magnetic core. When the switch is open, the stored energy flows from the core through the secondary winding into a rectifier that rectifies the AC signal into DC, which is stored by the input capacitance.

In another embodiment either an AC-DC or DC-DC power converter may be used to recharge the input capacitance in between bursts of pulses. In this embodiment the input of the converter is not connected to the typical DC power source associated with the engine. Instead, it is powered by an electrical alternator that generates AC power from mechanical work done by the engine. The alternating electrical energy generated by the alternator may or may not be rectified before it is connected to the input of the converter. In the case of rectification, the converter is DC-DC; in the case of no rectification, the converter is AC-DC. The advantage of this approach is that the electrical energy generated by the alternator may be controlled in such a way that it is input to the converter at a higher voltage level than the DC power source traditionally associated with the engine, which is 12-14 VDC for automotive engines. A higher input voltage relaxes design requirements for the converter, making it easier to charge the input capacitance to high voltages (>1 kV).

Figure 10:
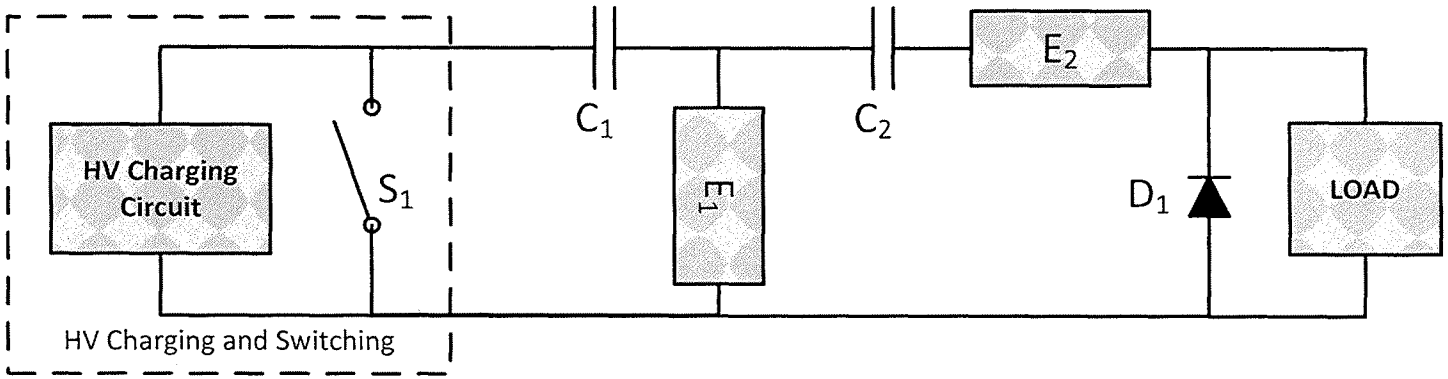
FIG. 10 is a graphical representation, depicting another circuit embodiment designed to produce one or more nanosecond pulses. Like the diodes $D_2$ and $D_3$ from FIGS. 8 and 9 respectively, diode $D_1$ in FIG. 10 operates as an opening switch. Energy is initially stored in capacitor $C_1$ and then subsequently switched by $S_1$ into a resonant circuit, where the components $C_1$, $C_2$, $E_1$, and $E_2$ comprise the resonant circuit.
Figure 11:
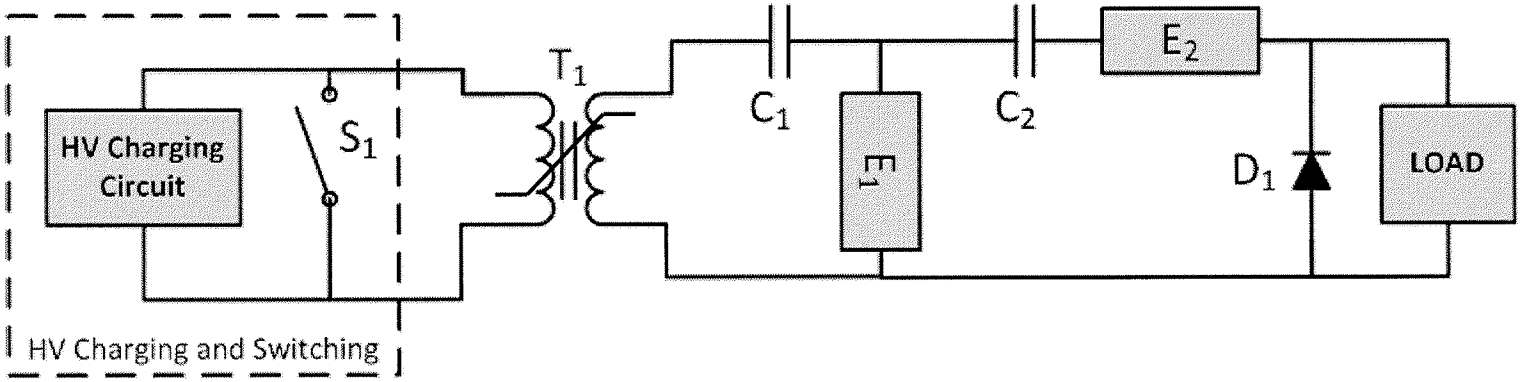
FIG. 11 is a graphical representation, depicting another embodiment of a circuit designed to produce one or more nanosecond pulses. This circuit operates in the same way as the circuit shown in FIG. 10, with the exception that a transformer, $T_1$, has been added between $S_1$ and $C_1$. The purpose of this transformer is to either step up the voltage or current that is switched by switch $S_1$, to provide pulse compression, or a combination all of these things.

In other embodiments depicted in FIG. 10 and FIG. 11, a diode $D_1$ is used as an opening switch. The principle mechanisms that govern the switching of this diode are the same as for the diodes $D_2$ and $D_3$, depicted in FIG. 8 and FIG. 9. For this embodiment, however, the diode $D_1$ is pumped differently. Energy is initially stored in capacitor $C_1$ and then subsequently switched by $S_1$ into a resonant circuit, where the components $C_1$, $C_2$, $E_1$, and $E_2$ comprise the resonant circuit. The energy resonates for approximately ¾ of one resonant period, during which time the diode is forward biased. After this time, the diode stops conducting, switching the energy into the load. Components $E_1$ and $E_2$ can be realized as a number of different elements, including transmission lines of a given characteristic impedance and phase velocity, as well as magnetic components, such as inductors or transformers. These magnetic components can be aircore or wound on a magnetic material, such as nanocrystalline ribbon, ferrite, iron powder, and other crystalline or amorphous magnetic materials.

FIG. 11 depicts a variation of this embodiment, in which a transformer, $T_1$, is added. The purpose of this transformer is to either step up the voltage or current that is switched by switch $S_1$, to provide pulse compression, or a combination all of these things. The step up of voltage or current can be useful for the purpose of relaxing the voltage and current ratings required for switch $S_1$. Pulse compression may be useful for relaxing the turn-on time requirement for switch $S_1$. The transformer $T_1$, therefore, may be designed to operate as a nonlinear or linear or a nonlinear transformer, depending on whether pulse compression is required or not. It may be wound on an aircore, or wound on a magnetic material, such as nanocrystalline ribbon, ferrite, iron powder, and other crystalline or amorphous magnetic materials.

Still further, practical applications, require a means of reliably transmitting the pulse from the repetitive transient plasma ignition source 22 to the igniter 26 or traditional spark plug. Existing ignition cable technology is inadequate. Existing ignition cables are designed to work with microsecond long pulses created by existing ignition systems and typically consist of an electrically insulated current carrying wire that is resistive. This type of cable works for traditional ignition systems because the length of the cable is short compared to the duration of the microsecond ignition pulse. This is not the case for nanosecond pulses, for which the ignition cables length makes up a significant fraction of the nanosecond pulse's duration. The fact that the cable appears to be electrically long to the nanosecond pulse means that the cable has the ability to seriously distort the pulse. Therefore, preventing the pulse from initiating a discharge at the spark plug. Thus, an ignition cable that differs from existing ignition cable technology is required to prevent the distortion of nanosecond energy pulses.

If pulses with nanosecond rise time and duration (i.e., rise time and fall time) are used to ignite the air-fuel mixture, pulse transmission becomes significantly more complex. The effects of having a current loop with a delay that is a significant fraction of the pulse's duration can be modeled effectively by distributed circuit parameters, such as inductance and capacitance. If a pulse propagates through poorly controlled inductive paths that are loaded by shunt capacitance, the pulse becomes significantly distorted (increased duration, reduced amplitude) and is, therefore, unable to ignite the air-fuel mixture.

Figure 12:
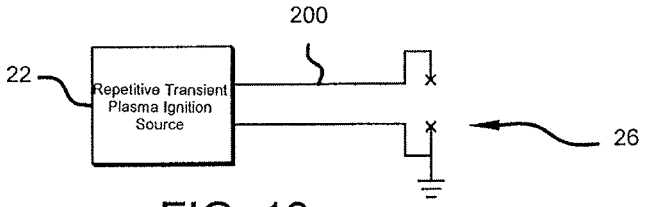
FIG. 12 is a schematic representation, depicting one approach to a pulse generator and ignition cable arrangement according to one embodiment.
Figure 13:
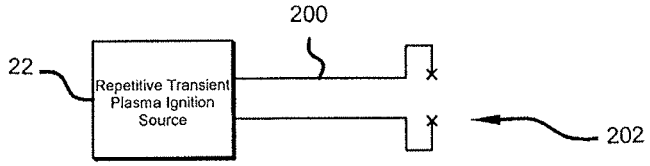
FIG. 13 is a schematic representation, depicting another approach to a pulse generator and ignition cable arrangement according to one embodiment.

In one arrangement (See FIG. 12), the repetitive transient plasma ignition source 22 is connected to an ignition cable 200 having the ability to transmit high voltage, fast rise pulses. The ignition cable 200 is, in turn, placed in electronic communication with the igniter 26 or standard spark plug. In another arrangement (FIG. 13), the transient plasma ignition source 22 and ignition cable 200 can be employed to provide high voltage, fast rise pulses to a differential spark plug 202, one that is electrically isolated. As will be developed below, in the second approach, the ignition cable 200 can embody an additional connector that acts as a shield and also connects to a system ground. In yet another arrangement, a transient plasma ignition assist 34 is connected between a traditional ignition coil 36 and the ignition cable 200. The ignition cable 200 is, in turn, placed in electronic communication with the igniter 26 or standard spark plug.

Figure 14:
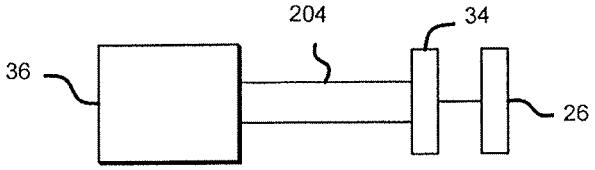
FIG. 14 is a schematic representation, depicting another approach using a standard ignition coil in association with a transient plasma plug assembly and a standard spark plug.

In FIG. 14, there is shown yet another embodiment. A traditional ignition coil 36 is connected to a standard ignition cable 204. This cable 204 is in electrical communication with a transient plasma ignition assist 34 having the ability to covert the electrical signal from the ignition coil 36 to a fast rise, high voltage pulse. This pulse is then electrically communicated to a standard, non-resistive spark plug or igniter 26. In some embodiments, the pulse may be electrically communicated to the standard, non-resistive spark plug or igniter 26 by attaching the transient plasma ignition assist 34 directly to the non-resistive spark plug or igniter in a way similar to how coil-on-plug ignition systems attach directly to the spark plug. This embodiment may be used when there is a need to maintain the use of standard spark plugs in the engine and to maintain lower costs than those associated with manufacturing a transient plasma ignition assist.

Figure 15A:
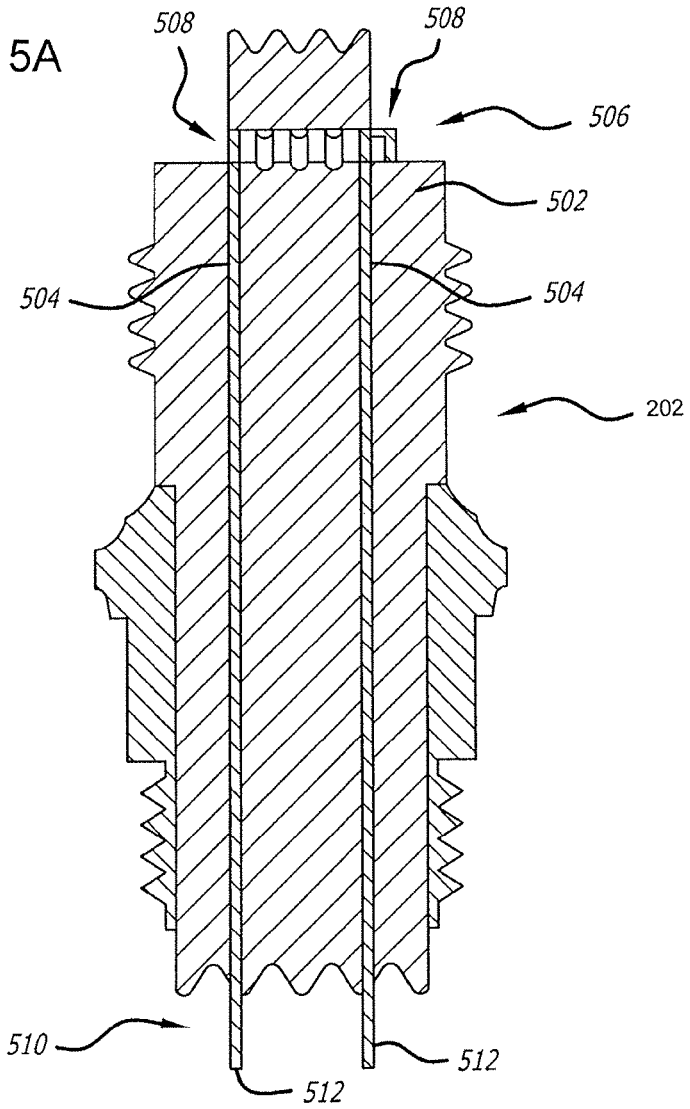
FIG. 15A is a cross-sectional view, depicting an embodiment of a differential spark plug.
Figure 15B:
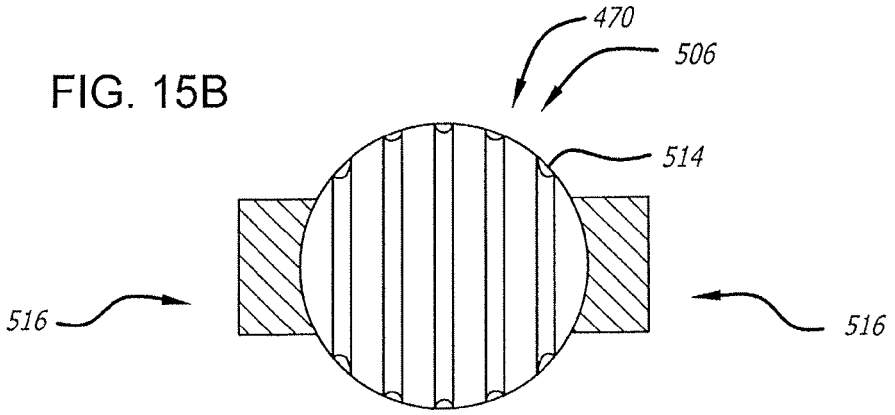
FIG. 15B is an enlarged end view, depicting an interface of the differential spark plug of FIG. 12A for connection to a cable assembly.

Continuing, with reference to FIGS. 15A-B, the presently described ignition cable 200 addresses these issues, making it possible to transmit high voltage, fast pulses from the transient plasma ignition source/assist to the igniter or electrode system.

In one embodiment, the differential spark plug assembly 470 has a generally elongate body defined in part by an elongate insulator 502, which as described above, can be made from $Al_2O_3$ or any other suitable material. Extending beyond a length of the insulator 502 are a pair of elongate conductors 504. The conductors 504 can, as before, be made from high nickel steel or other suitable materials. At a top end 506 of the plug assembly 470, first end portions of the conductors 504 form connection terminals 508. A bottom end 510 of the conductors can include tungsten (or other suitable materials) tips 512. Additionally, configured at the top end 506 is a ribbed insulator cap 514 attached to the first end portion of the conductors 504. Positive and negative terminals 516 are further provided at the top end 506, and which are presented for connection to a differential cable assembly (See FIGS. 15C-D).

Figure 15C:
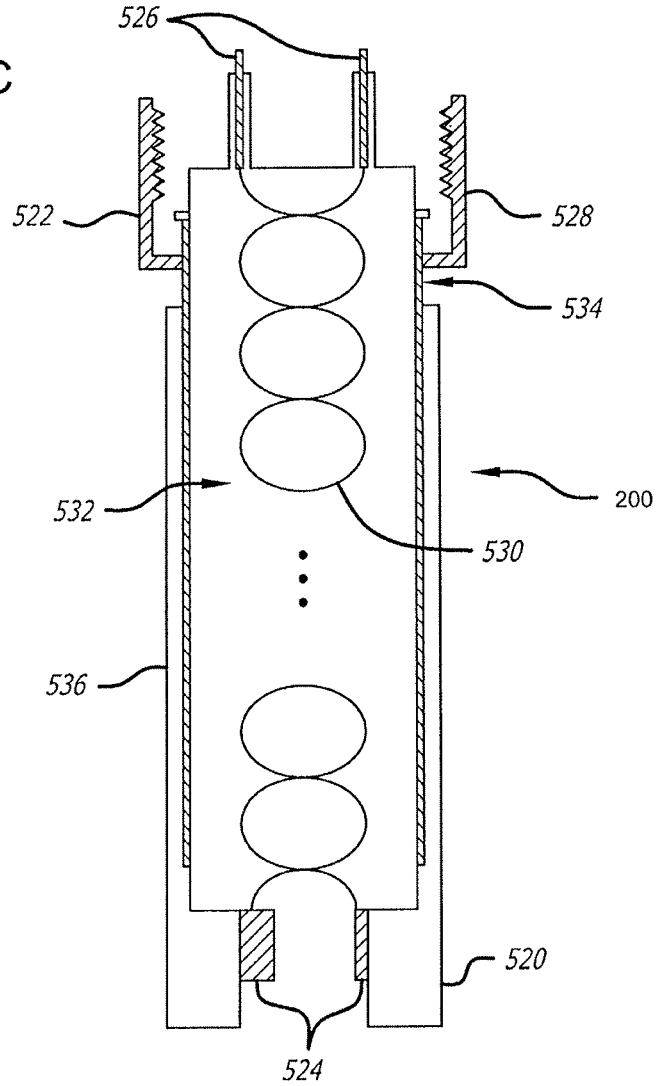
FIG. 15C is a cross-sectional view, depicting an embodiment of a differential ignition cable.
Figure 15D:
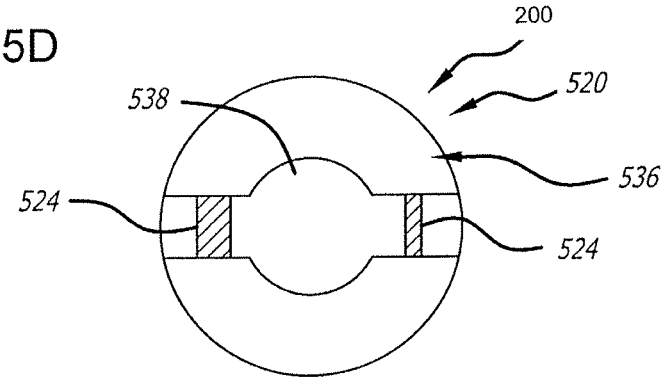
FIG. 15D is an enlarged end view, depicting structure of the cable of FIG. 15C for receiving an interface of a differential spark plug.

The differential cable assembly 200 depicted in FIGS. 15C-D includes an elongated body including a first end 520 for connecting to a differential spark plug 202, and a second end 522 configured to be connected to a transient plasma ignition source/assist (not shown). The first end 520 includes positive and negative terminals 524 for connecting to cooperative structure 516 presented by the differential plug 202. The second end 524 further includes positive and negative terminals 526 for connecting to the pulse generator. The second end 524 also includes a threaded connector 528 configured to be connected to system ground or common (not shown).

Extending from the positive and negative terminals 526 for connecting to a pulse generator, to the positive and negative terminals for connecting to the differential plug 202, is a twisted pair of conducting wires 530 housed in an insulator 532. Cable insulator material 532 (e.g., HDPE or other suitable material) contains the conductor wires 530. Configured about the insulator material 532 is a conductive jacket 534 which can be formed of a copper braid or other suitable material. An outer insulator 536 is further provided about the conductive jacket 534 to define a significant portion of an outer surface of the cable assembly 200. With specific reference to FIG. 15D, it can be appreciated that the first end 520 of the cable assembly includes a central bore 538 that is sized and shaped to receive the ribbed insulator 514 of the differential spark plug assembly 202, so that the positive and negative terminals of the two structures can be placed in contact. Again, here, it is to be recognized that various components can be added to or substituted from the presented cable assembly for a particular desired purpose.

In one approach, there is shown an ignition cable that is able to transmit nanosecond, high voltage electromagnetic pulses from a power source to a spark plug without distorting the electromagnetic pulse. The cable's ability to transmit fast rise pulses over electrical lengths significantly longer than the pulse's duration is a crucial enabling feature of the ignition cable described in this document. Most practical systems have an appreciably distance (e.g., 1 meter or more) between the igniter and the pulsed power source that creates the electromagnetic pulse used to ignite the air-fuel mixture. The propagation delay time of many practical cables is approximately 5 ns/meter, which is a significant fraction of the duration of a pulse that lasts for one to tens of nanoseconds. The disclosed ignition cables enables the nanosecond, high voltage pulse to travel distances longer than the pulse duration (meters of length, significant nanoseconds of time), which ensures that the pulse maintains its appropriate amplitude and duration when it arrives at the igniter/electrode.

Additionally, the controlled current carrying paths provided by the ignition cable arrangement, combined with the ability to electrically shield the current carrying paths, reduces the electromagnetic interference that is frequently associated with fast rising, high voltage signals.

In one embodiment of an ignition cable, there are two current carrying conductors arranged in a twisted pair configuration, where one conductor is isolated from the other with an electrical insulator. The effective inductance per unit length of the conductors (determined by their conductivity, individual geometry) combined with the effective capacitance per unit length (determined by the electrical insulator's effective permittivity, and the geometry of the conductors with respect to one another), fix the ratio of the electric field to the magnetic field, thus controlling the electromagnetic ignition pulse as it traverses the ignition cable. The effective inductance per unit length and the effective capacitance per unit length also determine the ignition cable's propagation delay, which is approximately 25-200% of ignition pulse's duration. These current carrying conductors will be surrounded by a third conductor that is electrically connected to the common or ground potential of the system, which is usually the potential of the metal chassis that holds the engine and auxiliary systems in place.

In one embodiment, the ignition cable is balanced, meaning that the ignition pulse's voltage is applied across the ignition cable's two current carrying conductors, which are both electrically insulated from a third conductor that is electrically connected to the system's common potential.

Accordingly, in one approach, the ignition cable includes conductors that carry the forward and return current are arranged to shape the electric and magnetic fields of the ignition pulse such that the ratio of the peak electric field and peak magnetic field are fixed over the length of the cable. This ratio is known, predictable, and adjustable within an upper and lower bound by changing cable materials and cable geometry. Further, the ignition cable's propagation delay, which describes the amount of time it takes a signal to travel from the cable's input to the cable's output, is also well known, predictably determined by the cable's material properties and geometry, and can be adjusted in a controlled manner within an upper and lower bound by changing cable materials and cable geometry. Thus, in one embodiment, the transient plasma pulse has a duration of 10 ns, the differential cable has a propagation velocity of 2 ns/m, and a length of 2 meters, the propagation delay of the cable is 40% of the transient plasma pulse duration. The ratio of cable propagation delay and pulse duration may take on other values depending on cable length, cable geometry, cable materials, and transient plasma pulse duration.

Moreover, the ignition cable can include at least two current carrying conductors, but may contain more conductors, current carrying or otherwise. For example, as stated above, a third conductor can be incorporated into the assembly for shielding a twisted pair and connector to a system ground where a differential (electrically isolated) spark plug is utilized. These conductors are physically isolated from each other by insulating material, which is chosen to provide electrical isolation and also to fix the effective capacitance between the current carrying wires. Additionally, the ignition cable may be either balanced or single ended. If single ended, one of the two current carrying conductors is electrically connected to both the return current point of the ignition pulse generator and the spark plug or electrode. If balanced, the current carrying conductors may be electrically isolated from the engine block and/or chassis and also enclosed by a third conductor that is electrically connected to the chassis, engine block, or any other reference point.

The following describes contemplated materials and assembly for achieving the desired performance of the cable:

1. The two current carrying conductors includes stranded copper wire, each 18 AWG (having diameter of 1.024 mm).

2. The two current carrying conductors are arranged as a helical twisted pair, with a constant spacing of 10 mm between each conductor, resulting in an inductance per unit length of 12 nH/cm.

3. The current carrying conductors are centered in and enclosed by a cylinder of PTFE (Teflon). This cylinder has an outer diameter of 2 cm. This arrangement results in a capacitance per unit length of 195 fF/cm.

4. The PTFE is shrouded by a copper braid that is at the same electric potential as the system's common potential. For most engines, this is the potential of the metal chassis that holds the engine, ignition pulse source, and auxiliary subsystems in place.

5. If the ignition electrode assembly (at the output side of the ignition cable) features an anode and cathode that are electrically isolated from the system's common potential, both current carrying conductors of the ignition cable are also electrically isolated from the system's common potential.

6. If the ignition electrode assembly (at the output side of the ignition cable) is such that either the anode or cathode is electrically connected to the system's common potential, then the copper braid that enshrouds the PTFE dielectric may be electrically connected at any point to whichever current carrying conductor is at common potential.

7. The combination of the ignition cable's inductance and capacitance results in an effective electromagnetic impedance of 250Ω and a propagation delay of 50 ps/cm.

8. The length of the cable is such that the resulting propagation delay is at least 10% of the ignition pulse's duration at half of the pulse's amplitude. This implies a minimum length of 0.2 m for a 10 ns ignition pulse, a minimum length of 1 m for a 50 ns pulse, etc.

Thus, a system and method involving a high voltage pulse generator and cooperating ignition cable can be utilized with traditional spark plugs to present a gas mixture with plasma streamers. Such plasma streamers accordingly couple with the gas mixture to create reactive species thereby enhancing efficiency of an engine performance. In other embodiments, the output of the transient plasma ignition source/assist may connect directly to the igniter or spark plug without a cable.

One of ordinary skill will appreciate that the disclosed high voltage, fast rise, ultra-short pulse technology may be applicable to other applications of nanoseconds high-voltage pulses including, but not limited to, exhaust emission reduction, cancer treatment, pulsed electric fields for improving juice extraction and sterilization of agricultural products, and an approach to aerodynamic improvements in aircraft.

The various embodiments and examples described above are provided by way of illustration only and should not be construed to limit the claimed invention, nor the scope of the various embodiments and examples. Those skilled in the art will readily recognize various modifications and changes that may be made to the claimed invention without following the example embodiments and applications illustrated and described herein, and without departing from the true spirit and scope of the claimed invention, which is set forth in the following claims.

We claim:

1. A method for igniting air-fuel mixtures, comprising:

generating multiple fast rising voltage pulses with a transient plasma ignition source;

creating a plurality of plasma streamers;

coupling the plasma streamers with an air-fuel mixture to create reactive species enhancing efficiency of combination chemistry.

2. A system for igniting air-fuel mixtures of an engine, comprising:

a generator of multiple fast rising pulses, the generator creating a plurality of plasma streamers;

an air-fuel mixture; and a circuit to effect a combination of the plurality of plasma streamers and the air-fuel mixture and creation of a reaction species enhancing efficiency of combustion chemistry of the engine.

3. The system of claim 2, further comprising a transient plasma ignition source that generates the multiple fast rising pulses which creates the plasma streamers.

4. The system of claim 3, wherein the transient plasma ignition source includes built-in circuitry.

5. The system of claim 4, wherein the built-in circuitry includes a diode.

6. The system of claim 4, wherein the built-in circuitry includes a plurality of capacitors.

7. The system of claim 2, further comprising a compression line circuit that generates the fast rising voltage pulses cooperating to create the plasma streamers.

8. The system of claim 7, further comprising an ignition cable configured to transmit the fast rising voltage pulses generated by the compression line circuit.

9. The system of claim 8, wherein the ignition cable carries forward and return current such that peak electronic and magnetic fields are fixed over a length of the cable and include electrical isolation for fixing effective capacitance.

10. The system of claim 8, wherein the cable is balanced and includes a third conductor.

11. The system of claim 2, wherein the pulses each have approximately a nanosecond duration.

* * * * *